US009643076B2

(12) United States Patent
Aamodt

(10) Patent No.: US 9,643,076 B2
(45) Date of Patent: May 9, 2017

(54) SKATEBOARD TRUCK WITH OFFSET BUSHING SEATS

(71) Applicant: Evan Aamodt, Philadelphia, PA (US)

(72) Inventor: Evan Aamodt, Philadelphia, PA (US)

(73) Assignee: Evan Aamodt, Philadelphia, PA (US)

( * ) Notice: Subject to any disclaimer, the term of this patent is extended or adjusted under 35 U.S.C. 154(b) by 0 days.

(21) Appl. No.: 14/847,827

(22) Filed: Sep. 8, 2015

(65) Prior Publication Data

US 2016/0023086 A1 Jan. 28, 2016

Related U.S. Application Data

(63) Continuation-in-part of application No. 14/339,431, filed on Jul. 23, 2014, now abandoned.

(60) Provisional application No. 62/047,601, filed on Sep. 8, 2014.

(51) Int. Cl.
*A63C 17/01* (2006.01)

(52) U.S. Cl.
CPC ..... *A63C 17/015* (2013.01)

(58) Field of Classification Search
CPC ..... A63C 17/0093; A63C 17/0046; A63C 17/0086; A63C 17/012
See application file for complete search history.

(56) References Cited

U.S. PATENT DOCUMENTS 4,155,565 A * 5/1979 de Caussin ..... A63C 17/0046 280/11.19
4,159,830 A * 7/1979 Solimine ..... A63C 17/012 280/11.28
4,311,319 A * 1/1982 Snyder ..... A63C 17/02 280/11.28
6,182,987 B1 * 2/2001 Bryant ..... A63C 17/0093 280/11.28
6,454,279 B1 * 9/2002 Yang ..... A43B 5/1633 280/11.223
7,104,558 B1 * 9/2006 Saldana ..... A63C 17/0093 280/11.27
7,192,039 B1 * 3/2007 Snedaker ..... A63C 17/0093 280/87.021
7,243,925 B2 * 7/2007 Lukoszek ..... A63C 17/0093 280/11.28
7,255,356 B2 * 8/2007 Lin ..... A63C 17/0086 280/87.041

(Continued)

*Primary Examiner* — Hau Phan
(74) *Attorney, Agent, or Firm* — Kelly G. Swartz; Widerman Malek, PL

(57) ABSTRACT

A skateboard truck assembly having a base, a hanger, a first bushing pin, and a second bushing pin. The base configured for attachment to a skateboard deck, having a first bushing pin receiving passageway formed in a medial portion thereof and a second bushing pin receiving passageway formed in a rear portion thereof. The hanger adapted to be connected to the base and having a first and second bushing seat. The first bushing pin adapted to extend through the first bushing seat, to be carried by the first bushing pin receiving passageway, and to carry a first bushing adapted to be positioned at least partially within the first bushing seat. The second bushing pin adapted to be fixedly carried by the second bushing pin receiving passageway and to carry a second bushing adapted to be positioned at least partially within the second bushing seat.

20 Claims, 8 Drawing Sheets

(56) References Cited

U.S. PATENT DOCUMENTS

| | | | | |
|---|---|---|---|---|
| 7,837,204 | B1 * | 11/2010 | Groenenboom | A63C 17/0093 280/11.27 |
| 8,083,241 | B2 * | 12/2011 | Corrente | A63C 17/0046 280/87.042 |
| 8,684,370 | B2 * | 4/2014 | Baumann | A63C 17/0093 280/11.27 |
| 8,888,108 | B1 * | 11/2014 | Beaty | A63C 17/012 280/11.27 |
| 2003/0098554 | A1 * | 5/2003 | Chen | A63C 17/0086 280/11.27 |
| 2004/0041360 | A1 * | 3/2004 | Lukoszek | A63C 17/0093 280/11.27 |
| 2006/0097470 | A1 * | 5/2006 | Chmelar | A63C 17/0093 280/87.042 |
| 2011/0095500 | A1 * | 4/2011 | De Las Casas | A63C 17/0046 280/87.042 |
| 2011/0148055 | A1 | 6/2011 | Visinski et al. | |
| 2012/0068428 | A1 | 3/2012 | Visinski et al. | |
| 2013/0113170 | A1 | 5/2013 | Braden et al. | |
| 2013/0270781 | A1 | 10/2013 | Kuyt | |
| 2014/0062045 | A1 * | 3/2014 | Rawlins | A63C 17/0093 280/87.042 |

* cited by examiner

SKATEBOARD TRUCK WITH OFFSET BUSHING SEATS

RELATED APPLICATIONS

This application is a continuation-in-part and claims the benefit under 35 U.S.C. §120 of U.S. application Ser. No. 14/339,431 filed on Jul. 23, 2014 and titled Adjustable Base for Longboard Reverse Kingpin Truck, the entire contents of which are incorporated herein by reference. This application also claims the benefit under 35 U.S.C. §119(e) of U.S. Provisional Patent Application Ser. No. 62/047,601 filed on Sep. 8, 2014 and titled Skateboard Truck with Offset Busing Seats, the entire contents of which are incorporated herein by reference.

FIELD OF THE INVENTION

The present invention relates to skateboard trucks. More specifically the present invention provides a skateboard truck assembly with vertically offset first and second bushing seats.

BACKGROUND

In addition to securing the wheels of a skateboard to its deck, the skateboard truck assembly plays an important role in the overall maneuverability of the skateboard, including, in particular, the rider's ability to control the direction of the board's travel. Several types of skateboard trucks exist and its ultimate design is subject to variation. However, in general, most truck assemblies tend to operate on the basic principle that a change in the rider's position on the board (e.g., through a shift in weight or "pumping" one's legs) can be at least partially translated to a change in the direction of the skateboard's motion. However, many conventional truck assemblies exhibit a variety of drawbacks that can adversely impact the operation of the skateboard in terms of rider flexibility, performance, and safety. For example, conventional trucks place an extreme amount of stress on the reverse kingpin, which can oftentimes result in failed or broken parts. This creates a hazardous situation for the rider. In addition, many traditionally-designed skateboard trucks geometrically limit the skateboard's turning ability, which is the method used to slow the skateboard down when riding on uneven or sloped (e. g., mountainous) terrain. To increase turning ability users will often loosen their trucks or use softer bushings, which consequently reduces stability, especially at high speeds. This can be extremely dangerous, as it can cause "speed wobble," which can result in severe injury or even death. Also, many known conventional reverse kingpin truck designs are not ideal because the end of the kingpin, nut and or washer protrude beyond the hanger and will interfere if a rider tries to grind the hanger on an object such as a rail or curb. Thus, a need exists for a robust, yet versatile, skateboard truck design that maximizes the turning ability, grinding ability and performance of the skateboard while retaining a suitable degree of stability and enhancing both rider control and safety.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a skateboard truck assembly having a base, a hanger, a first bushing pin, and a second bushing pin. The base may be configured for attachment to a skateboard deck. The base may have a first bushing pin receiving passageway formed in a medial portion thereof and a second bushing pin receiving passageway formed in a rear portion thereof. The hanger may be adapted to be connected to the base. The hanger may have a first bushing seat and a second bushing seat. The first bushing pin may be adapted to extend through the first bushing seat, to be carried by the first bushing pin receiving passageway, and to carry a first bushing. The first bushing may be adapted to be positioned at least partially in contact with the first bushing seat. The second bushing pin may be adapted to be fixedly carried by the second bushing pin receiving passageway and to carry a second bushing adapted to be positioned at least partially in contact with the second bushing seat.

The hanger may have a road side and a board side. The first bushing seat may be on the road side and the second bushing seat may be on the board side. The first bushing seat and the second bushing seat may both be on either the road side or the board side.

The base may have a pivot receiver formed in a base forward portion and at least one mounting aperture.

A pivot insert may be adapted to be carried between the pivot and the pivot receiver.

The hanger may have a front edge. The first bushing seat may have a first bushing seat center located a first distance from the front edge. The second bushing seat may have a second bushing seat center located a second distance from the front edge. The first distance may not be equal to the second distance.

The first bushing seat may have a first bushing seat back wall. The second bushing seat may have a second bushing seat back wall. The first bushing seat back wall may be located in a first horizontal plane. The second bushing seat back wall may also be located in the first horizontal plane.

The hanger may have a pivot, which may have a center axis in the first horizontal plane.

The second bushing seat may be blind.

The skateboard hanger may have a first bushing seat and a second bushing seat. The first bushing seat may have a first bushing seat center with a first bushing seat aperture formed there through. The first bushing seat may be adapted to capture a first bushing. The second bushing seat may have a second bushing seat center not vertically aligned with the first bushing seat center. The second bushing seat may be adapted to contact a second bushing carried by a second bushing pin fixedly captured by a second bushing pin receiving passageway disposed on a base.

The second bushing seat may have a center configured to align with a second bushing pin receiving passageway on the base. The first bushing seat aperture may have a center configured to align with a first bushing pin receiving passageway on the base.

The hanger may have a forward portion. The first bushing seat may have a first bushing seat center located a first distance from the forward portion. The second busing seat may have a second bushing seat center located a second distance from the forward portion. The first distance may not be equal to the second distance. The first distance may be shorter than the second distance.

The skateboard truck assembly may have a base, a hanger, a first bushing pin, a first bushing, a second bushing pin, and a second bushing. The base may be configured for attachment to a skateboard deck. The base may have a first bushing pin receiving passageway formed in a medial portion thereof and a second bushing pin receiving passageway formed in a rear portion thereof. The hanger may be adapted to be connected to the base. The hanger may have a board side, a road side, a first bushing seat on the road side, and a blind second bushing seat on the board side. The first bushing pin may be adapted to extend through the first bushing seat and to be carried by the first bushing pin receiving passageway. The first bushing may be adapted to be carried by the first bushing pin and adapted to be located at least partially in contact with the first bushing seat. The second bushing pin may be adapted to be fixedly carried by the second bushing pin receiving passageway. The second bushing may be adapted to be carried by the second bushing pin and adapted to be located at least partially in contact with the blind second bushing seat.

The skateboard truck assembly may have a pivot insert. The base may have a pivot receiving passageway in a forward portion thereof and at least one mounting aperture adapted to secure the base to a deck. The hanger may have a pivot adapted to carry the pivot insert between the pivot receiving passageway and the pivot. The first bushing seat may have a first bushing seat back wall. The second bushing seat may have a second bushing seat back wall. The first bushing seat back wall may be located in a first horizontal plane. The second bushing seat back wall may be located in the first horizontal plane. The center axis may be in the first horizontal plane. The first bushing seat may have a first bushing seat center located a first distance from the pivot. The second bushing seat may have a second bushing seat center located a second distance from the pivot. The first distance may be less than the second distance.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Figure 1:
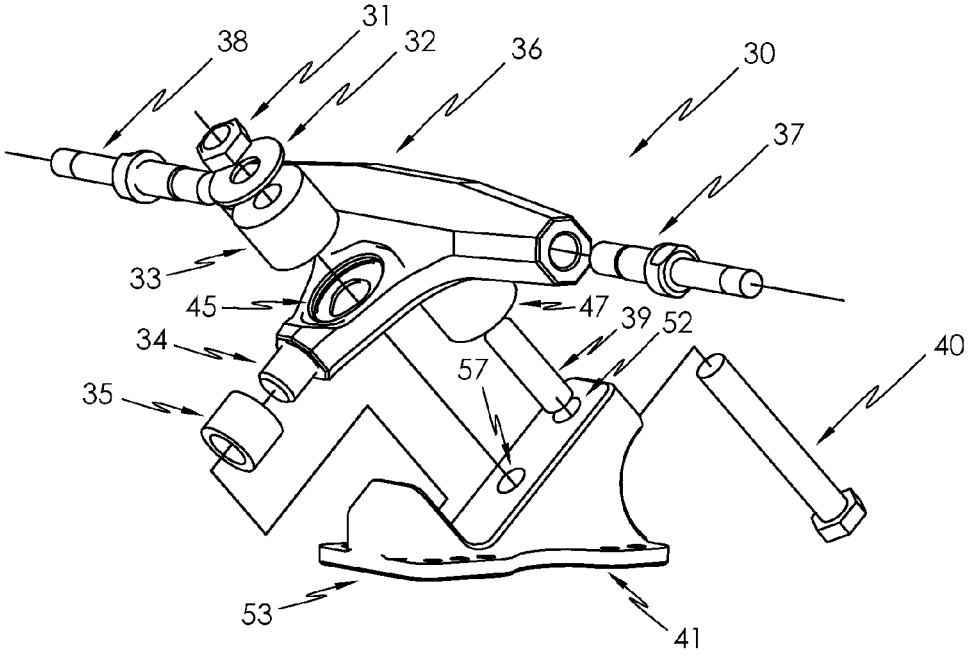
FIG. 1 is an exploded side perspective view of a skateboard truck assembly according to an embodiment of the present invention.

An embodiment of the invention, as shown and described by the various figures and accompanying text, provides a skateboard truck, a hanger with two bushing seats, and two bushing pins. As depicted in FIG. 1, the skateboard truck 30 may have a base 41, hanger 36, and a first and second bushing pin 40, 39 adapted to secure the hanger 36 to the base 41. The first bushing 33 and the second bushing 47 may control, or limit, movement of the hanger 36 relative to the base 41 in the skateboard truck assembly 30.

The thickness of the bushing seat(s) 45, 46 may contributes to radial compression of the bushings 33, 47, which can limit the amount of turn a skateboard truck is capable of. The bushing placement relative the pivot 34 and the axles 37, 38 of a skateboard truck assembly 30 may affect the amount of side-to-side play in a skateboard truck assembly 30. In an embodiment of the inventive design, the first and second bushing seats 45, 46 may be vertically offset from one another. By positioning one or more bushings 33, 47 away from the pivot 34 in this way, it is possible to reduce the amount of the side-to-side play. This is advantageous for precise handling of the skateboard at speed.

Figure 5:
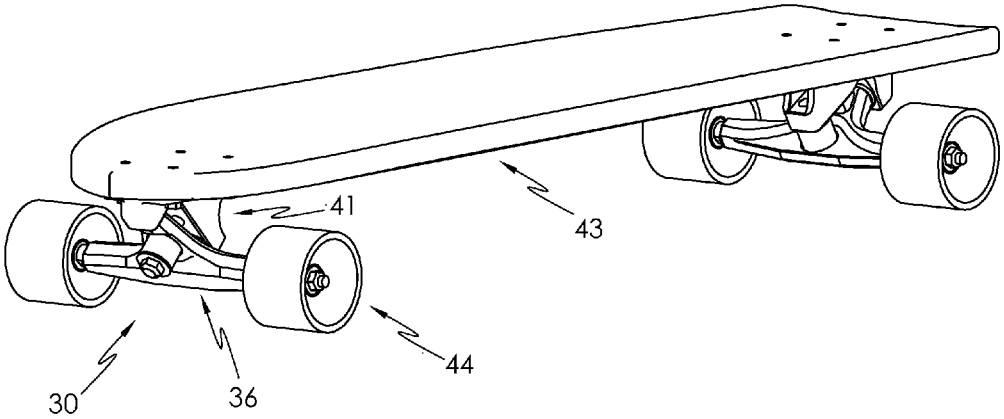
FIG. 5 is a side perspective view of a skateboard incorporating the skateboard truck assembly of FIG. 1
Figure 6:
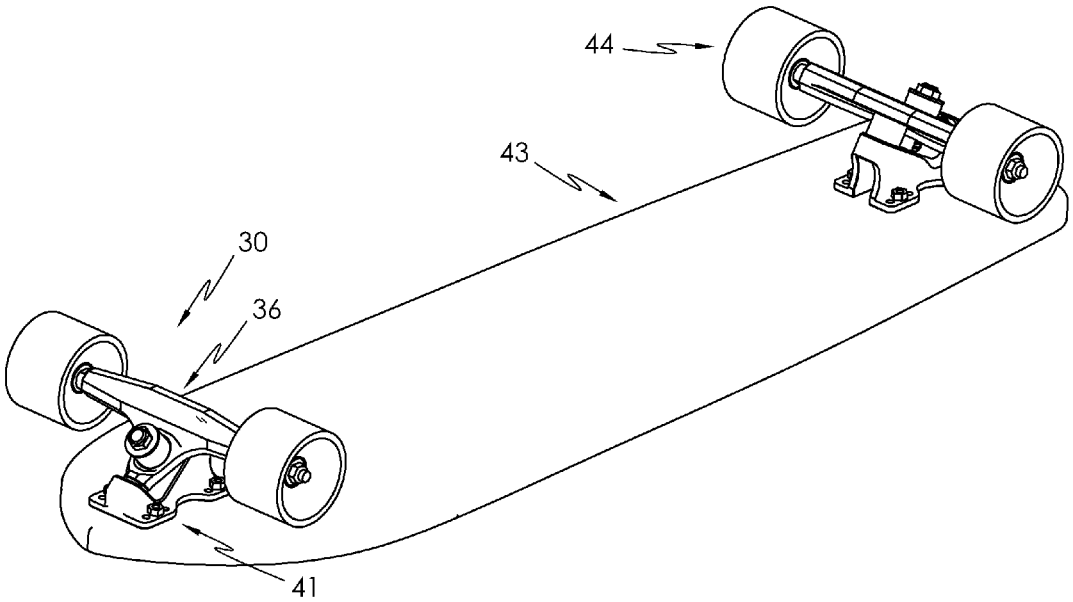
FIG. 6 is a bottom perspective view of a skateboard incorporating the skateboard truck assembly of FIG. 1.

As depicted in FIGS. 5 and 6, the base 41 may be configured for attachment to a skateboard deck 43. The base 41 may be secured to the bottom of a skateboard deck 43 utilizing at least one mounting aperture 49 on the base 41. A plurality of mounting apertures 49 may be disposed along the perimeter of the base 41. At least one mounting aperture 49 may be located on each of the left and right sides of the base 41. At least one mounting aperture 49 may be located at each of the front and back sides of the base 41. The at least one mounting aperture 49 may be located on and extend through a portion of the base 41 adapted to contact the skateboard deck 43.

The base 41 may have a forward portion 53, a medial portion 57, and a rear portion 52. A skateboard deck 43 may utilize a pair of bases 41. When secured to the skateboard deck 43 the forward portion 53 of each respective base 41 may be proximate the end of the skateboard deck 43 nearest the respective base 41. The rear portion 52 of each respective base 41 may be distal the end of the skateboard deck 43 nearest the respective base 41. A pair of bases 41 secured to a skateboard deck 43 may oppose one another.

When secured to the skateboard deck 43, the base may have a top surface positioned distal the skateboard deck 43 and a bottom surface positioned proximate or adjacent the skateboard deck 43. The bottom surface may be flat. An angle, a1, may be formed in the top surface. On either side of the angle, a1, the top surface may be an inclined plane. The angle may be located one third the length of the base 41 from the front side of the base 41. The angle, a1, may be 90°. The portion of the base 41 between the front side and the angle may be the forward portion 53 of the base 41. A pivot receiver 48 may be disposed in the forward portion. At least one bushing pin may be contact with the base outside of the forward portion. The two-thirds of the base 41 located proximate the backside of the base 41 may be the rear portion 52 of the base 41. The rear portion 52 of the base 41 may form an angle, a2, with respect to the bottom surface of the base. The portion of the base 41 between the back side and the angle may be the hanger mounting portion of the base 41. The medial third of the base 41 may be the medial portion 57 of the base 41. The medial portion 57 of the base 41 may be the portion of the base 41 located between the midpoint of the medial portion 57 of the base 41 and the angle. The rear portion 52 of the base 41 may be the third of the base 41 located proximate the back side of the base 41. The rear portion 52 of the base 41 may be the portion of the base 41 located between the midpoints of the medial portion 57 and the back side of the base 41.

Figure 9:
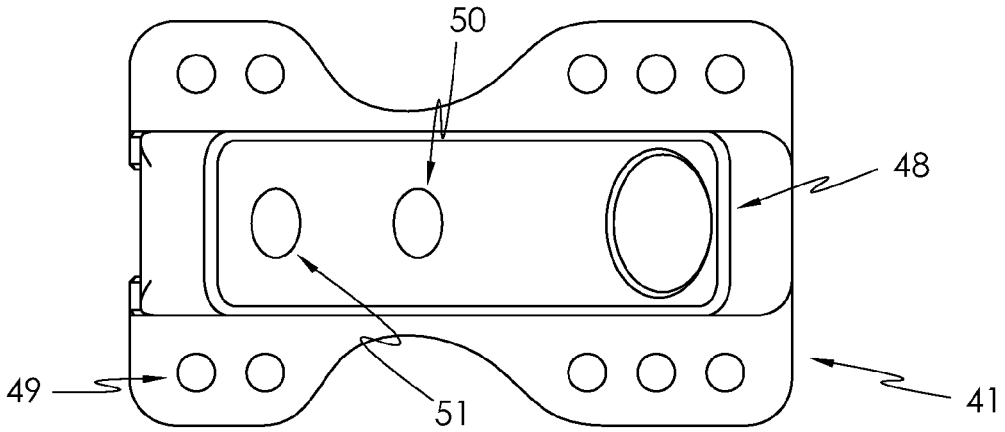
FIG. 9 is a top view of the base of the skateboard truck assembly of FIG.

As shown at least in FIG. 9, the base may have a first bushing pin receiving passageway 50 on the top surface. The first bushing pin receiving passageway 50 may be formed in a medial portion of the base 41. The first bushing pin receiving passageway 50 may be adapted to carry a first bushing pin 40. The first bushing pin receiving passageway 50 may be a void disposed in the base 41. The first bushing pin receiving passageway 50 may have a rear wall laying in a plane parallel to the plane of the surface of the base 41 in which the first bushing pin receiver passageway 50 is located. The first bushing pin 40 may be adapted to contact the rear wall of the first bushing pin receiving passageway 50 and extend outside of the first bushing pin receiving passageway 50. The first bushing pin receiving passageway 50 may be adapted to fixedly retain the first bushing pin 40 within the passageway 50 and prevent, limit, or minimize lateral movement of the first bushing pin 40 with respect to the sidewalls of the first bushing pin receiving passageway 50.

Also shown at least in FIG. 9, the base may have a second bushing pin receiving passageway 51 on the top surface. The second bushing pin receiving passageway 51 may be formed in a rear portion of the base 41. The second bushing pin receiving passageway 51 may be adapted to carry a second bushing pin 39. The second bushing pin receiving passageway 51 may be a void disposed in the base 41. The second bushing pin receiving passageway 51 may have a rear wall laying in a plane parallel to the plane of the surface of the base 41 in which the second bushing pin receiver passageway 51 is located. This plane may also be parallel to the plane of the surface of the base 41 in which the first bushing pin receiver passageway 50 is located. The second bushing pin 39 may be adapted to contact the rear wall of the second bushing pin receiving passageway 51 and extend outside of the second bushing pin receiving passageway 51. The second bushing pin receiving passageway 51 may be adapted to fixedly retain the second bushing pin 39 within the passageway 51 and prevent, limit, or minimize lateral movement of the second bushing pin 39 with respect to the sidewalls of the second bushing pin receiving passageway 51.

A pivot receiver 48 may be formed in a forward portion 53 of the base 41. The pivot receiver 48 may be a recess in the surface of the base 41. The pivot receiver 48 may be configured to retain a pivot 34 disposed on the hanger 36. A pivot insert 35 may be adapted to be carried between the pivot 34 and the pivot receiver 48. The pivot insert 35 may be a pivot cup, a pivot sleeve, or the like.

Figure 7:
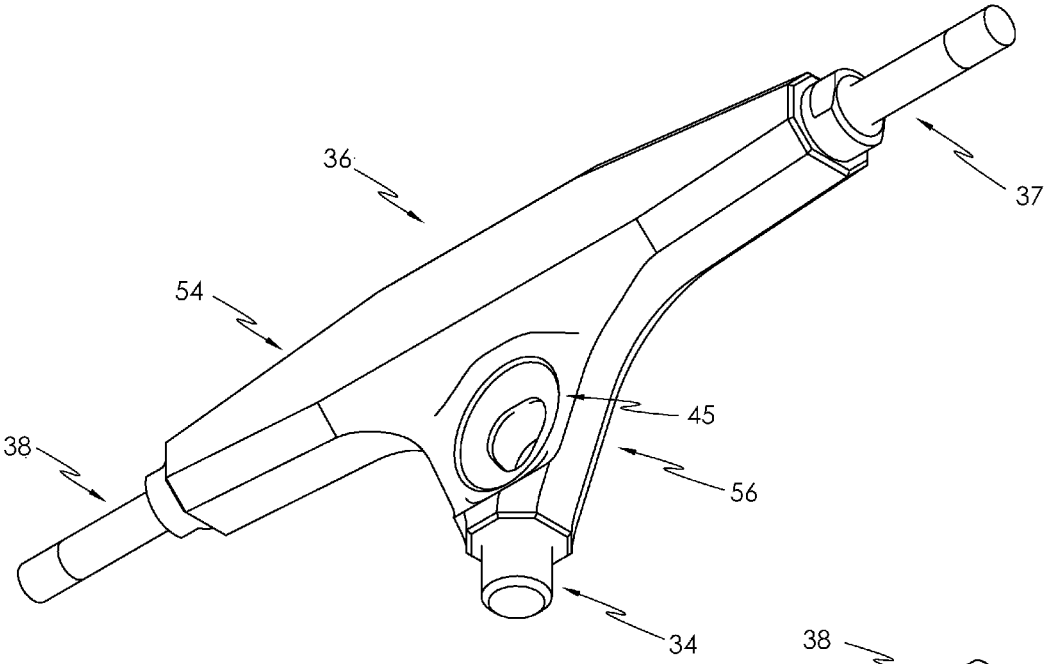
FIG. 7 is a front perspective view of the hanger of the skateboard truck assembly of FIG. 1.
Figure 8:
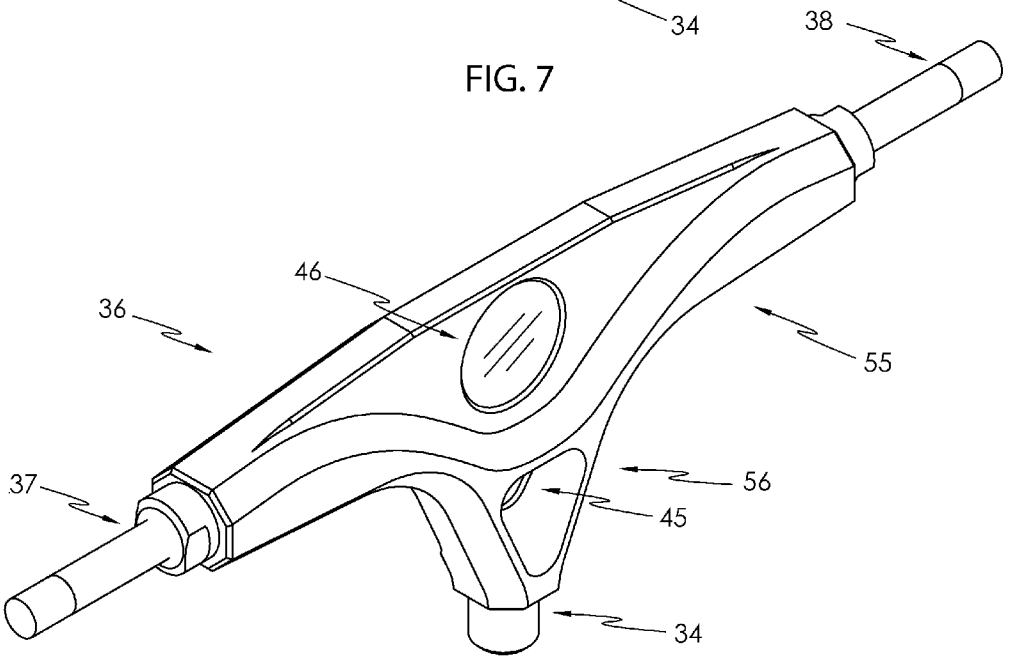
FIG. 8 is a back perspective view of the hanger of the skateboard truck assembly of FIG. 1.

A hanger 36 may be adapted to be connected to the base 41. The hanger 36 may have a road side 54, shown in FIG. 7, and a board side 55, shown in FIG. 8. The road side 54 may oppose the board side 55. The hanger may have a forward portion located proximate the forward portion of the base when secured thereto. The hanger may have a front edge adjacent or proximate to the forward portion 53 of the base when secured thereto. A distal end of the pivot 34 may be the front edge of the hanger 36. The hanger may have a back edge opposing the front edge. The hanger 36 have a rear portion located proximate the rear portion of the base when secured thereto. The rear portion of the hanger 36 may oppose the forward portion of the hanger 36. The hanger 36 may have a first bushing seat 45 and a second bushing seat 46.

A pivot 34 may be formed on a forward portion of the hanger 36. The pivot 34 may be received by the pivot receiver 48 formed on the base 41. The pivot 34 may be a protuberance formed on the forward portion of the hanger 36. The pivot 34 may be formed on the front edge of the hanger 36. The pivot 34 may have a center axis extending the length of the pivot 34.

The first bushing seat 45 may be configured to carry a first bushing 33 positioned at least partially within the first bushing seat 45. The first bushing seat 45 may be a location on the surface of the hanger 36 adapted to contact a first bushing 33. The first bushing seat 45 may be a circular recess in the surface of the hanger 36. The first bushing seat 45 may have at least one sidewall extending from an outer surface of the hanger 36 to a first bushing seat back wall. The distance between the outer surface of the hanger 36 and the first bushing seat back wall may define the depth of the first bushing seat 45. The first bushing seat 45 may be located on the road side 54 of the hanger 36. The first bushing seat 45 may be located on the board side 55 of the hanger. The first bushing seat 45 may be blind.

The second bushing seat 46 may be configured to carry a second bushing 47 positioned at least partially within the second bushing seat 46. The second bushing seat 46 may be a location on the surface of the hanger 36 adapted to contact a second bushing 47. The second bushing seat 46 may be a circular recess in the surface of the hanger 36. The second bushing seat 46 may have at least one sidewall extending from an outer surface of the hanger 36 to a second bushing seat back wall. The distance between the outer surface of the hanger 36 and the second bushing seat back wall may define the depth of the second bushing seat 46. The second bushing seat 46 may be located on the road side 54 of the hanger 36.

The second bushing seat 46 may be located on the board side 55 of the hanger. The second bushing seat 46 may be blind.

The first bushing seat 45 and the second bushing seat 46 may be disposed on opposing sides of the hanger 36. The first bushing seat 45 and the second bushing seat 46 may be disposed on the same side of the hanger 36.

The first bushing seat 45 may have a first bushing seat center. The first bushing seat center may be configured to align with a first bushing pin receiving passageway on the base. The second bushing seat 46 may have a second bushing seat center. The second bushing seat center may be configured to align with a second bushing pin receiving passageway on the base. The first bushing seat center may not be aligned with the second bushing seat center. The first bushing seat center being not aligned with the second bushing seat center means that a straight pin could not extend through both the first bushing seat center and the second bushing seat center. The first bushing seat center may be located a first distance from the front edge of the hanger 36. These second bushing seat center may be located a second distance from the front edge of the hanger 36. The first distance may not be equal to the second distance. The second distance may be greater than the first distance.

The first bushing seat back wall may lie in a first horizontal plane. The second bushing seat back wall may lie in a second horizontal plane. The first bushing seat 45 and the second bushing seat 46 may be configured so that both the first bushing seat back wall the second bushing seat back wall are in the same horizontal plane. The first horizontal plane or the second horizontal plane may extend along a center axis of the pivot 34. The first bushing seat 45 and the second bushing seat 46 may be configured so that the first horizontal plane is different from the second horizontal plane. The first horizontal plane may be parallel to the second horizontal plane. The distance between two horizontal planes may be referred to as a thickness between the first bushing seat 45 and the second bushing seat 46.

Figure 4:
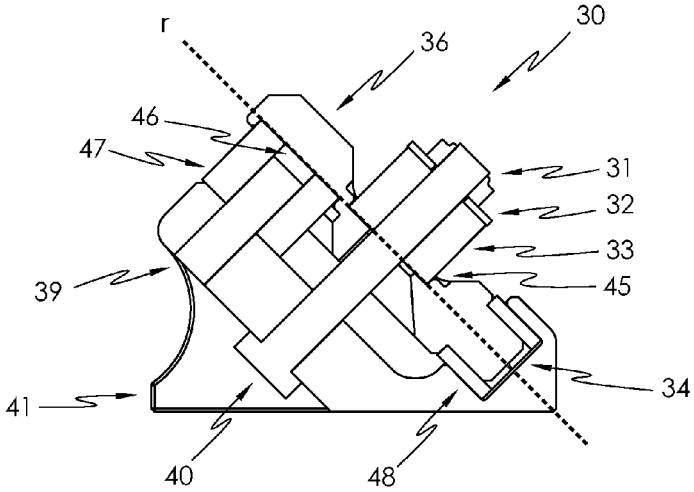
FIG. 4 is a cross section view of the skateboard truck assembly taken through the 4-4 line in FIG. 3.

As shown at least in FIG. 4, the first bushing seat back wall lies in the same horizontal plane as the second bushing seat back wall. In FIG. 4, the center axis of the pivot 34 also lies in the same horizontal plane as the bushing seat back walls. The skateboard truck assembly 30 may rotate about the axis of rotation, r, when pressure is applied to either of a pair of wheels 44 disposed on the first axle 37 and the second axle 38.

Figure 14:
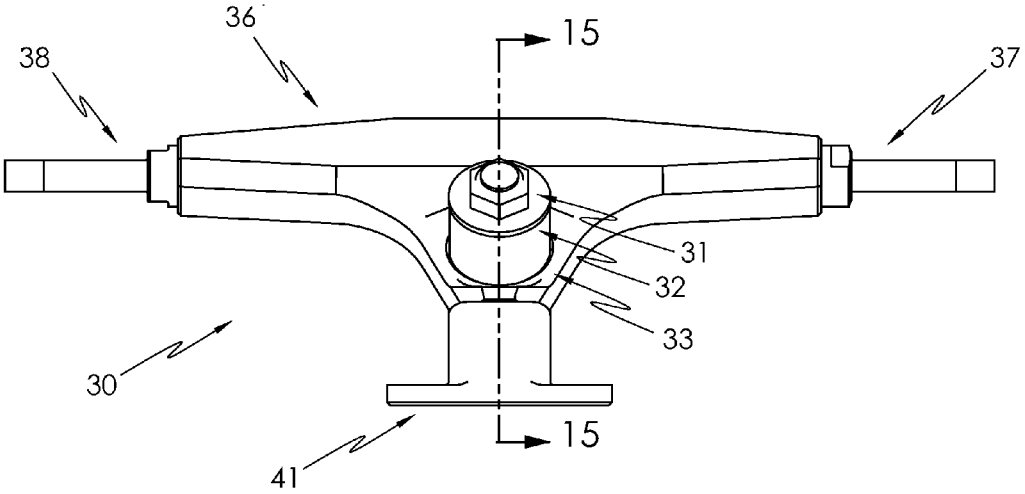
FIG. 14 is a front view of a skateboard truck assembly according to an embodiment of the present invention.
Figure 15:
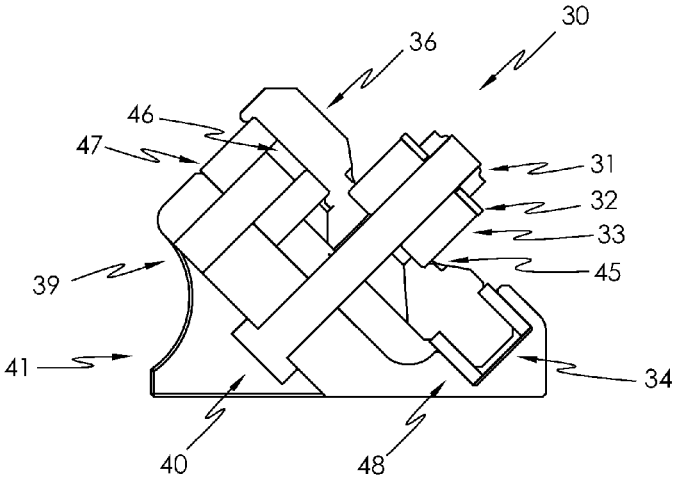
FIG. 15 is a cross section view of the skateboard truck assembly taken through the 15-15 line in FIG. 14.

As shown at least in FIG. 15, the embodiment depicted in FIG. 14, has a first bushing seat back wall that lies in a first horizontal plane. The second bushing seat back wall lies in a second horizontal plane parallel to the first horizontal plane. In FIG. 15, the center axis of the pivot 34 lies in a third horizontal plane, which may be parallel to the first and second horizontal planes.

An aperture may be located in the first bushing seat back wall. The aperture may be adapted to allow a first bushing pin 42 extend through the first bushing seat 45.

A first bushing pin 40 may be adapted to be carried by the first bushing pin receiving passageway 50 and to carry a first bushing 33. The first bushing pin 40 may be adapted to extend from a back wall of the first bushing pin receiving passageway 50 through the first bushing seat 46 and carry a first bushing 33 a washer 32 and a nut 31. The first bushing pin 40 may be threaded on at least one portion. The threaded portion may be a distal end. The threaded portion of the first bushing pin 40 may secure the nut 31. In one embodiment, the first bushing 33 may be located on a road side of the hanger 36. In another embodiment, the first bushing 33 may be located on a board side of the hanger 36.

A second bushing pin 39 may be adapted to be carried by the second bushing pin receiving passageway 51 and to carry a second bushing 47. The second bushing pin 39 may be adapted to extend from a back wall of the second bushing pin receiving passageway 51 and carry a second bushing 47. The second bushing pin 39 may not be of sufficient length to extend from the back wall of the second bushing pin receiving passageway 51 and contact the hanger 36. The second bushing pin 39 may not be adapted to contact the hanger 36. In one embodiment, the second bushing 47 may be located on a road side of the hanger 36. In another embodiment, the second bushing 47 may be located on a board side of the hanger 36. The second bushing pin 39 may be adapted to be fixedly captured by the second bushing pin receiving passageway 51. The second bushing pin 39 may be fixedly captured when lateral motion of the second bushing pin 39 with respect to the second bushing pin receiving passageway sidewalls is limited, prevented, or minimized.

A first bushing 33 may be adapted to be positioned at least partially within the first bushing seat 45. The first bushing 33 may be cylindrical with an aperture disposed through the entirety of length of the cylinder from a proximate end to a distal end. The first bushing 33 may be configured to allow the first bushing pin 40 to be positioned through the aperture disposed through the length of the cylinder. The first bushing 33 may be adapted to allow the base of the first bushing 33 to contact the first bushing seat 45 or a back wall of the first bushing seat 45. The first bushing 33 may be adapted to allow the sides of the first bushing 33 to contact the sidewalls of the first bushing seat 45 when the base of the first bushing 33 is in contact with the back wall of the first bushing seat 45. The length of the first bushing 33 may be greater than the sidewalls of the first bushing seat 45.

A second bushing 47 may be adapted to be positioned at least partially within the second bushing seat 46. The second bushing 47 may be cylindrical with an aperture disposed through the entirety of length of the cylinder from a proximate end to a distal end. The second bushing 47 may have a passageway disposed through only a portion of the length of the cylinder. The second bushing 47 may be configured to allow the second bushing pin 39 to be positioned in the passageway located along the length of the cylinder. The second bushing 47 may be adapted to allow the base of the second bushing 33 to contact the second bushing seat 46 or the back wall of the second bushing seat 46. The second bushing 47 may be adapted to allow the sides of the second bushing 47 to contact the sidewalls of the second bushing seat 46 when the base of the second bushing 47 is in contact with the back wall of the second bushing seat 46. The length of the second bushing 47 may be greater than the sidewalls of the second bushing seat 46.

The first bushing seat 45 may have a first bushing seat center and the second bushing seat 46 may have a second bushing seat center. The first bushing seat center may be positioned relative the second bushing seat center such that a rigid, straight pin could not simultaneously retain a first bushing 33 in the first bushing seat 45 and a second bushing 47 in the second bushing seat 46. Such a configuration of the first bushing seat 45 and the second bushing seat 46 may be referred to as not vertically aligned.

In one embodiment, the first bushing seat 45 may be on the road side of the hanger 36 and the second bushing seat 46 may be on the board side 55 of the hanger 36. In one embodiment, the first bushing seat 45 may be on the board side of the hanger 36 in the second bushing seat 46 may be on the road side 54 of the hanger 36. In one embodiment, the first bushing seat 45 and the second bushing seat 46 may be on the board side 55 of the hanger 36. In one embodiment, the first bushing seat 45 and the second bushing seat 46 may be on the road side 54 of the hanger 36.

Figure 10:
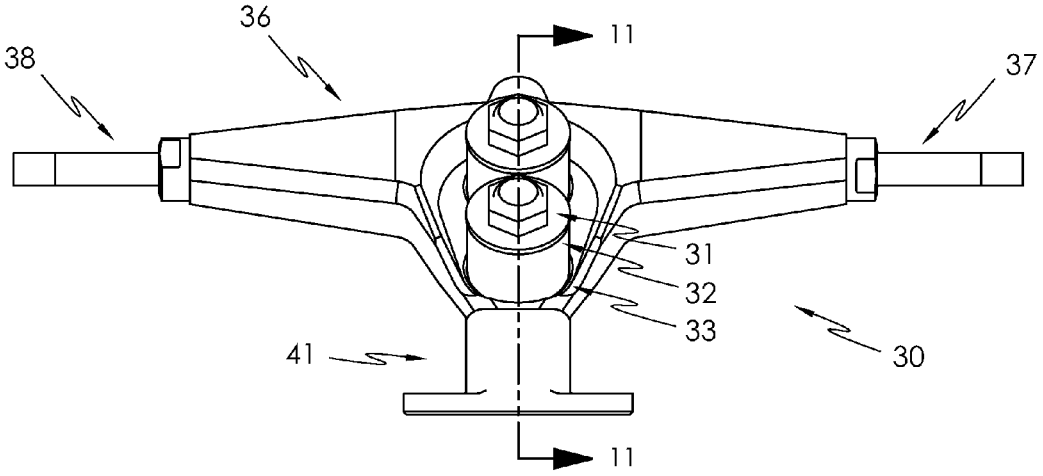
FIG. 10 is a front view of a skateboard truck assembly according to an embodiment of the present invention.
Figure 11:
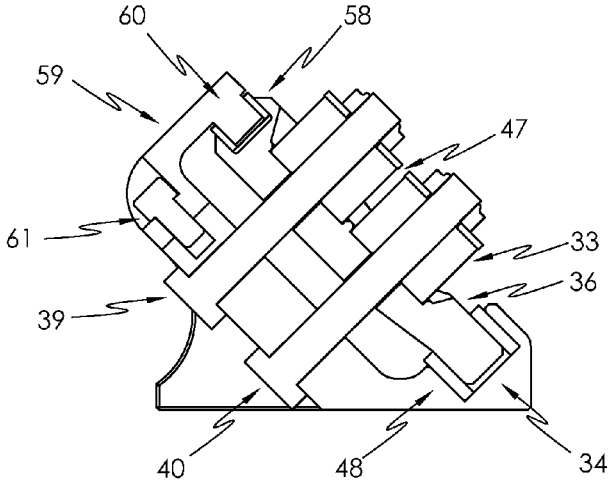
FIG. 11 is a cross section view of the skateboard truck assembly taken through the 11-11 line in FIG. 10.

FIG. 10 depicts an embodiment in which both the first bushing seat 45 and the second bushing seat 46 are disposed on the road side 54 of the hanger. The cross section depicted in FIG. 11 shows components that may be utilized in such a configuration. A hanger pivot receiver 58 may be disposed on the hanger 36 and adapted to receive a base pivot 60 disposed on a support arm 59 adapted to be removably secured to the base 41. The support arm 59 may be removable from the base 41. A screw 61 may be used to secure the support arm 59 to the base 41 through a mounting hole disposed in a proximate end of the support arm 59. The screw 61 may be secured to the base 41 using a threaded passageway disposed on a rear portion of the base 41. When secured to the base, the support arm 59 may extend from the rear portion of the base 36 and contact at least a portion of the hanger 36. The support arm 59 may have a protuberance disposed on an end distal the rear portion of the base 41. The protuberance may be a base pivot 60 and may be adapted to be retained or carried by the hanger pivot receiver 58.

Figure 12:
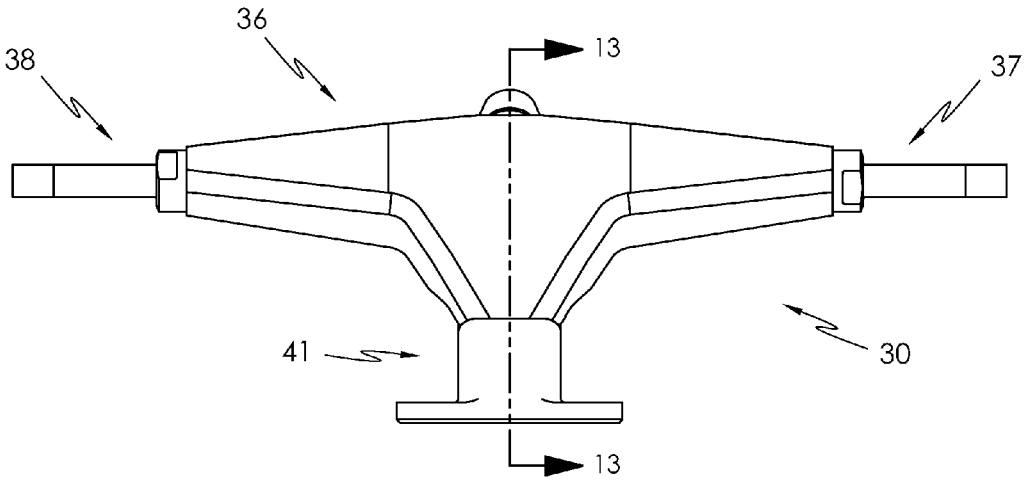
FIG. 12 is a front view of the skateboard truck assembly according to an embodiment of the present invention.
Figure 13:
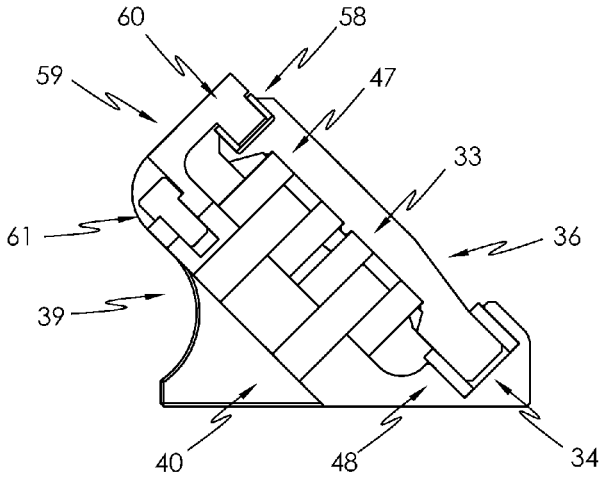
FIG. 13 is a cross section view of the skateboard truck assembly taken through the 13-13 line in FIG. 12.

FIG. 12 depicts an embodiment in which both the first bushing seat 45 and the second bushing seat 46 are disposed on the board side 55 of the hanger. The cross section depicted in FIG. 13 shows components that may be utilized in such a configuration. A hanger pivot receiver 58 may be disposed on the hanger 36 and adapted to receive a base pivot 60 disposed on a support arm 59 adapted to be removably secured to the base 41. The support arm 59 may be removable from the base 41. A screw 61 may be used to secure the support arm 59 to the base 41 through a mounting hole disposed in a proximate end of the support arm 59. The screw 61 may be secured to the base 41 using a threaded passageway disposed on a rear portion of the base 41. When secured to the base, the support arm 59 may extend from the rear portion of the base 36 and contact at least a portion of the hanger 36. The support arm 59 may have a protuberance disposed on an end distal the rear portion of the base 41. The protuberance may be a base pivot 60 and may be adapted to be retained or carried by the hanger pivot receiver 58.

Figure 2:
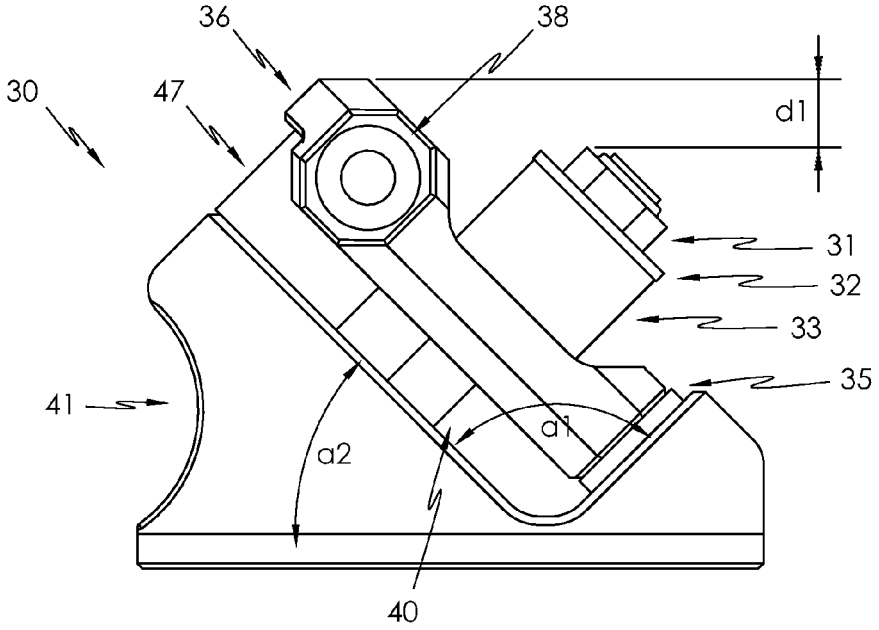
FIG. 2 is a side view of the skateboard truck assembly of FIG. 1.
Figure 3:
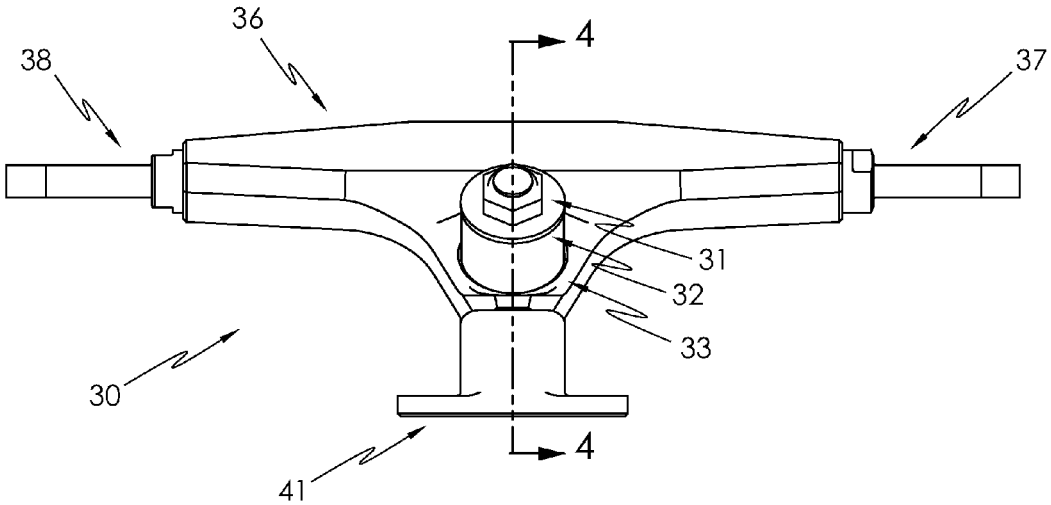
FIG. 3 is a front view of the skateboard truck assembly of FIG. 1.

FIG. 2 depicts the location of the first bushing 33 with respect to the back edge of the hanger 36. There may be some vertical distance dl between the top of the nut 31 or the first bushing pin 39, which ever extends higher, and the back edge of the hanger 36. The distance dl may allow the skateboard user to grind the hanger 36 against objects without interference from the first bushing pin 39 or the nut 31.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

That which is claimed is:

1. A skateboard truck assembly comprising:

a base configured for attachment to a skateboard deck, the base having a first bushing pin receiving passageway formed between a pivot receiver and a second bushing pin receiving passageway formed in a rear portion thereof;

a hanger adapted to be connected to the base, the hanger having a first bushing seat and a second bushing seat;

a first bushing pin adapted to extend through the first bushing seat, to be carried by the first bushing pin receiving passageway, and to carry a first bushing, and no other bushing, adapted to be positioned at least partially in direct contact with the first bushing seat; and a second bushing pin adapted to be fixedly carried by the second bushing pin receiving passageway and to carry a second bushing, and no other bushing, adapted to be positioned at least partially in direct contact with the second bushing seat.

2. The skateboard truck assembly according to claim 1 wherein the hanger has a road side and a board side, the first bushing seat being on the road side, and the second bushing seat being on the board side.

3. The skateboard truck assembly according to claim 1 wherein the base has a pivot receiver formed in a base forward portion and at least one mounting aperture.

4. The skateboard truck assembly according to claim 1 wherein the hanger has a road side and a board side, the first bushing seat and the second bushing seat both being on either the road side or the board side.

5. The skateboard truck assembly according to claim 4 further comprising a pivot insert adapted to be carried between the pivot and the pivot receiver.

6. The skateboard truck assembly according to claim 1 wherein the hanger has a front edge, the first bushing seat has a first bushing seat center located a first distance from the front edge, the second bushing seat has a second bushing seat center located a second distance from the front edge, no bushing other than the first and second bushings are used, and the first distance is not equal to the second distance.

7. The skateboard truck assembly according to claim 1 wherein the first bushing seat has a first bushing seat back wall, the second bushing seat has a second bushing seat back wall, the first bushing seat back wall is located in a first horizontal plane, no bushing other than the first and second bushings are used, and the second bushing seat back wall is located in the first horizontal plane.

8. The skateboard truck assembly according to claim 7 wherein the hanger has a pivot having a center axis in the first horizontal plane.

9. The skateboard truck assembly according to claim 1 wherein the second bushing seat is blind.

10. A skateboard hanger comprising:

a first bushing seat, having a first bushing seat center with a first bushing seat aperture formed there through, adapted to capture and directly contact a first bushing;

a second bushing seat, having a second bushing seat center not vertically aligned with and parallel to the first bushing seat center, adapted to directly contact a second bushing carried by a second bushing pin fixedly captured by a second bushing pin receiving passageway disposed on a base; and wherein no other bushings are in contact with the skateboard hanger.

11. The skateboard hanger according to claim 10 wherein the skateboard hanger has a road side and a board side, the first bushing seat being on the road side, and the second bushing seat being on the board side.

12. The skateboard hanger according to claim 10 wherein the skateboard hanger has a road side and a board side, both the first bushing seat and the second bushing seat being on either the road side or the board side.

13. The skateboard hanger according to claim 10 wherein the second bushing seat is blind.

14. The skateboard hanger according to claim 10 wherein the second bushing seat has a center configured to align with a second bushing pin receiving passageway on the base and the first bushing seat aperture has a center configured to align with a first bushing pin receiving passageway on the base.

15. The skateboard truck assembly according to claim 10 wherein the first bushing seat has a first bushing seat back wall, the second bushing seat has a second bushing seat back wall, the first bushing seat back wall being located in a first horizontal plane, and the second bushing seat back wall being located in the first horizontal plane.

16. The skateboard truck assembly according to claim 15 wherein the hanger has a pivot with a center axis in the horizontal plane.

17. The skateboard truck assembly according to claim 10 wherein the hanger has a forward portion, the first bushing seat has a first bushing seat center located a first distance from the forward portion, the second busing seat has a second bushing seat center located a second distance from the forward portion, and the first distance is not equal to the second distance.

18. The skateboard truck assembly according to claim 17 wherein the first distance is shorter than the second distance.

19. A skateboard truck assembly comprising:

a base configured for attachment to a skateboard deck, the base having a first bushing pin receiving passageway formed between a pivot receiver and a second bushing pin receiving passageway formed in a rear portion thereof;

a hanger adapted to be connected to the base, having a board side, a road side, a first bushing seat on the road side, and a blind second bushing seat on the board side;

a first bushing pin adapted to extend through the first bushing seat and to be carried by the first bushing pin receiving passageway;

a first bushing adapted to be carried by the first bushing pin, which carries no additional bushing, and adapted to be located at least partially within and in direct contact with the first bushing seat;

a second bushing pin adapted to be fixedly carried by the second bushing pin receiving passageway; and a second bushing adapted to be carried by the second bushing pin, which carries no additional bushing, and adapted to be located at least partially within and in direct contact with the blind second bushing seat.

20. The skateboard truck assembly according to claim 19 further comprising:

a pivot insert;

wherein the base has a pivot receiving passageway in a forward portion thereof and at least one mounting aperture adapted to secure the base to a deck;

wherein the hanger has a pivot, having a center axis, adapted to carry the pivot insert between the pivot receiving passageway and the pivot;

wherein the first bushing seat has a first bushing seat back wall, the second bushing seat has a second bushing seat back wall, the first bushing seat back wall is located in a first horizontal plane, the second bushing seat back wall is located in the first horizontal plane, and the center axis is in the first horizontal plane; and wherein the first bushing seat has a first bushing seat center located a first distance from the pivot, the second bushing seat has a second bushing seat center located a second distance from the pivot, and the first distance is less than the second distance.

* * * * *